United States Patent [19]

Balasingam

[11] Patent Number: 4,739,639

[45] Date of Patent: Apr. 26, 1988

[54] AUTO-DIRECTING LEVER LOCK

[76] Inventor: Cathirgamathamby Balasingam, 102/2 Wolfendahl Street, Colombo 13,

[21] Appl. No.: 911,568

[22] Filed: Sep. 25, 1986

[51] Int. Cl.[4] ..... E05B 25/00

[52] U.S. Cl. ..... 70/355; 70/353; 70/365; 70/419; 70/423; 70/455

[58] Field of Search ..... 70/353–355, 70/362, 365, 366, 455, 419–421, 423

[56] References Cited

U.S. PATENT DOCUMENTS

| | | | |
|---|---|---|---|
| 8,071 | 5/1851 | Yale | 70/354 |
| 17,139 | 4/1857 | Diss | 70/354 |
| 17,681 | 6/1857 | Johnson | 70/354 X |
| 173,932 | 2/1876 | Foehner | 70/423 X |
| 199,023 | 1/1878 | Border | 70/355 |
| 303,498 | 8/1884 | Demming | 70/355 |
| 306,976 | 10/1884 | Thumshirn | 70/355 |
| 615,206 | 11/1898 | Babcock | 70/419 X |
| 913,923 | 3/1909 | Solomon | 70/419 X |
| 1,702,430 | 2/1929 | Fremon | 70/419 X |
| 1,904,882 | 4/1933 | Prior, Jr. | 70/423 X |
| 2,179,947 | 11/1939 | Miller | 70/419 X |
| 2,528,964 | 11/1950 | Lurtz | 70/419 |
| 2,696,727 | 12/1954 | Schlabach | 70/421 |
| 4,599,877 | 7/1986 | Rabinow | 70/366 |

FOREIGN PATENT DOCUMENTS

| | | | |
|---|---|---|---|
| 278556 | 10/1927 | United Kingdom | 70/353 |
| 503174 | 4/1939 | United Kingdom | 70/353 |

*Primary Examiner*—Robert L. Wolfe
*Assistant Examiner*—Suzanne L. Dino
*Attorney, Agent, or Firm*—D. Peter Hochberg; Mark M. Kusner; Walter C. Danison, Jr.

[57] ABSTRACT

An auto-directing lever lock includes a case housing a cylinder (4) with a plug (3) mounted for movement therein. The plug includes a keyway (14) for accepting a key bit (7). A keyway opening (15) on the surface of the plug provides access for lever tumblers (6) to engage lever steps on the key bit. The key bit is detachable from a bow and shank section (8), and inserted in to the keyway through a key hole (39) in the case. The tumblers ride on a surface of the plug and are held away from the lever steps of the key bit during rotation of the plug, until the tumblers disengage the plug surface due to the keyway opening therein. The tumblers, when disengaged from the plug surface, fall onto the lever steps of the key bit to align gatings (32) of the tumblers so a bolt stump (28) may pass therethrough to retract a bolt (5) of the lock.

17 Claims, 3 Drawing Sheets

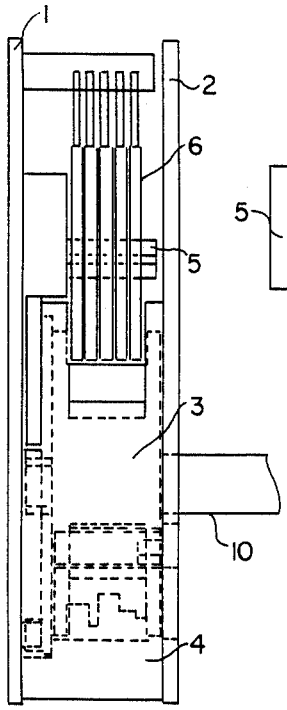
FIG. 2
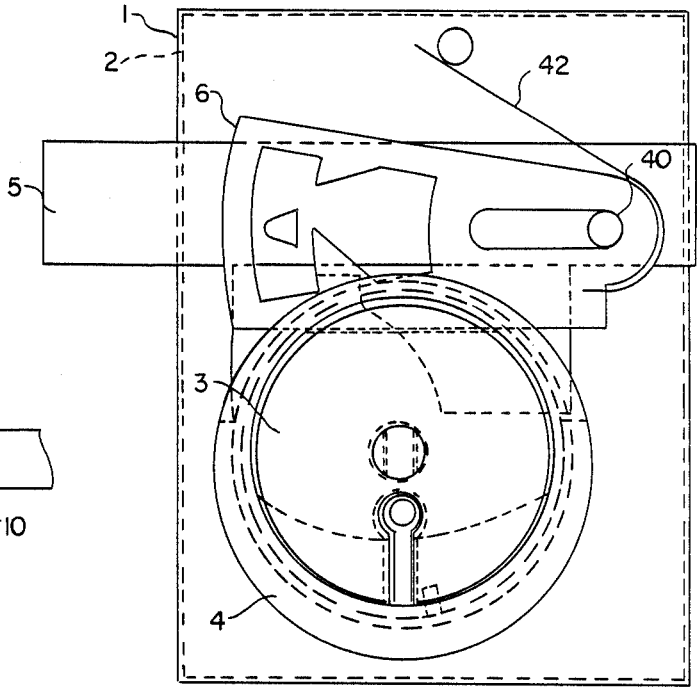
FIG. 1
FIG. 3
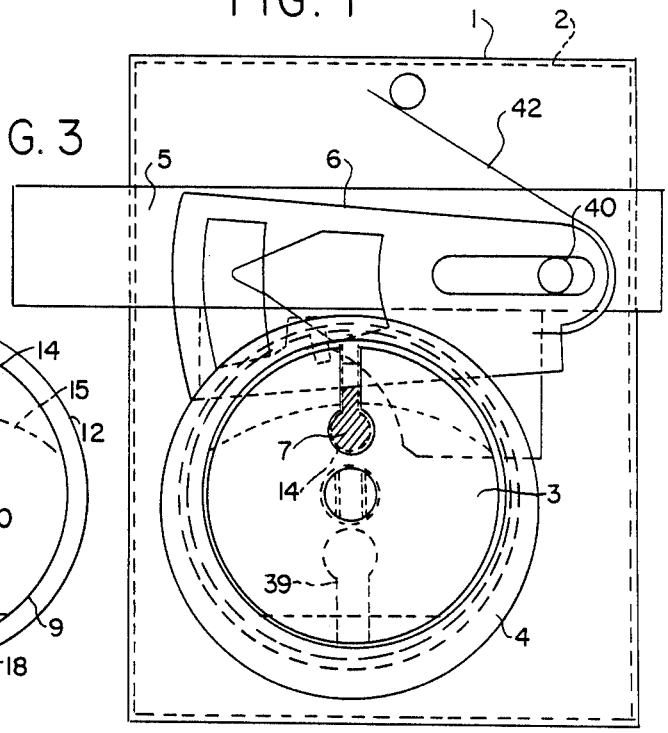
FIG. 4
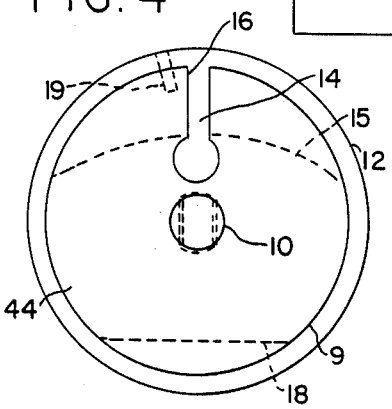

FIG. 12
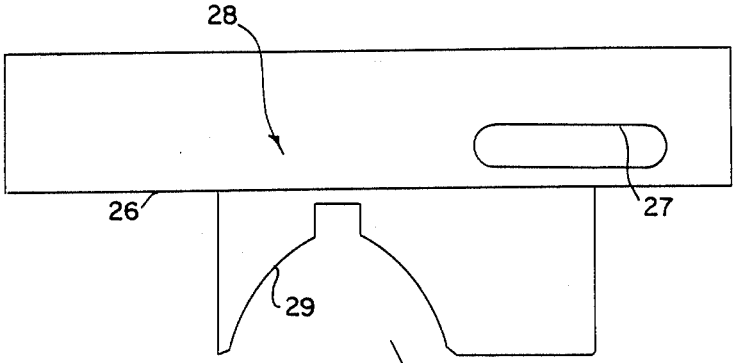
FIG. 13
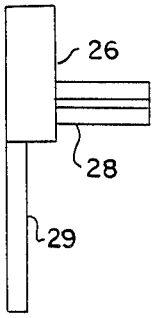
FIG. 14
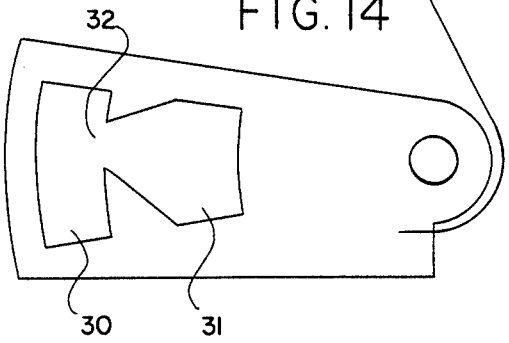
FIG. 15
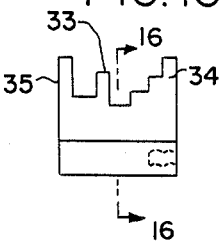
FIG. 16
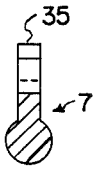
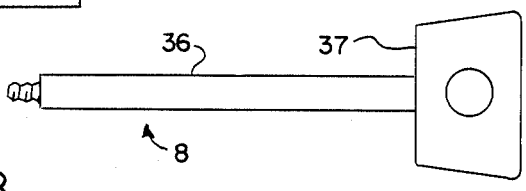
FIG. 17
FIG. 18
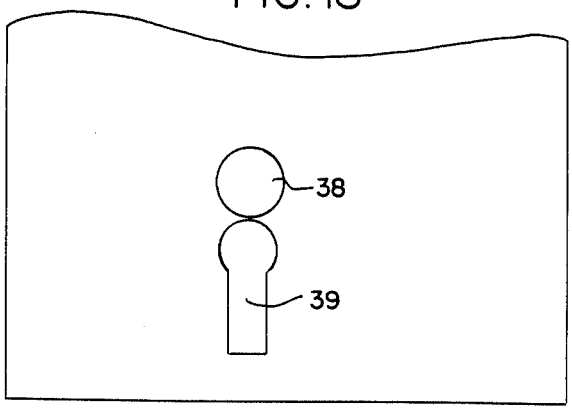

AUTO-DIRECTING LEVER LOCK

TECHNICAL FIELD

This invention relates to key-operated, high security lever locks particularly meant for use of safes and vault doors.

BACKGROUND ART

Generally lever locks contain a plurality of pivoted lever tumblers and a dead bolt, all of which are directly engaged by a rotating key. In such locks lever steps on a key bit engage the lever tumblers and a bolt step on the key bit engages a bolt talon for moving the bolt. A bolt stump projecting from the bolt travels on the tumblers between lever pockets through lever gatings, determining on the tumblers locking and unlocking of the lock. Such locks can be locked and unlocked only when the lever steps cause the gatings to be aligned, thus enabling the bolt stump to travel between the lever pockets.

Such prior art lever locks are pickable. The key held in hand by its bow end on the outside, directly contacts the bellies of the lever tumblers and the bolt talon inside the lock when the key is rotated. Thus, there is always available a continuous and clear passage from the outside of the lock through the keyhole and leading to the lever tumblers and bolt.

The lever tumblers and the bolt in conventional locks are independent of each other to a great extent. Every lever tumbler can be lifted or moved independently. The bolt can also be independently moved laterally up to a point where the bolt stump which is positioned within lever pockets of the tumblers, is prevented from further movement due to non-alignment of the gatings.

Operating with suitable picking tools through the keyhole, continuous pressure can be applied on the bolt talon while simultaneously lifting every lever tumbler separately so it is made to travel against the bolt stump. By this method the points of resistance for the individual lever tumbers can be analyzed and the lock successfully picked.

High security lever locks known in the prior art are provided with various additional security devices like detectors, protectors, detents, false notches, barrels and curtains, bullets, wards and guards, etc. These additional devices make the task of picking more difficult and time-consuming but not theoretically impossible.

Lever locks are lockable only by using their keys. This is also a drawback when dealing with emergency locking such as during holdups.

Thus there exists a need in the prior art for a lever lock that is theoretically unpickable and which can be locked without using its key.

DISCLOSURE OF THE INVENTION

An object of the present invention is to provide a theoretically unpickable lever lock.

A further object of the present invention is to provide a lever lock with facilities for automatic or self-locking without the use of its key.

It is a further object of the present invention to provide a lever lock with dual control by double throw of the bolt using two (2) keys having different lever steps.

Further objects of the present invention will be made apparent from the Best Modes for Carrying Out Invention and the appended claims.

The foregoing objects are accomplished by a lever lock provided with a hollow cylinder and a solid plug, one of which is permanently fastened to the lock case and the other of which is rotatable about its longitudinal access adjacent the fastened one. The axial part of the rotating plug or cylinder is connected at its front side to a thin spindle which projects through a hole in the lock case cap plate and extends to the outside of the door. The spindle serves as movement means for the rotatable member. The lock is operated by rotation of a spindle handle fitted at the end of the spindle.

In a preferred form of the invention, a fixed hollow cylinder open at both ends and mounted on a lock case and a rotatable solid plug positioned therein, are arranged with the front ends of both the cylinder and plug touching the inside of a cap plate of the lock. The plug incorporates a keyway for accepting and holding a key bit, in the form of a longitudinal slit on one side. The keyway extends along the length of the plug from the front end to a point near the rear. In cross section the keyway extends from a point away from the axis adjacent the spindle to the periphery of the plug. The keyway is so positioned that when the key bit is inserted, a plurality of lever steps on the key bit lie toward the periphery of the plug and a shank edge is parallel to the longitudinal axis.

A keyhold approximately the same size as the keyway is cut through the cap plate of the lock at the front directly below the spindle hole. The keyhole is the same distance from the longitudinal axis as the keyway. An access hole corresponding to the keyhole also extends through the door to which the lock is attached to enable inserting the key bit into the lock. In this arrangement, with the plug enclosed in the cylinder and with the front ends of both the plug and the cylinder touching the inside of the lock cap plate, the keyway when in alignment with the keyhole becomes a blind passage sealed on all sides except through the keyhole. When the plug is slightly rotated fromt his position, the keyway moves away from the keyhole; thus totally sealing the keyhole by an end face of the plug. The keyhole will remain sealed by the face of the plug until the plug rotates a full round and returns to its original aligned position.

The keyway in the plug is suitably opened over a major portion of its middle section. A wide opening is cut through the top side wall of the cylinder over an area corresponding to the middle section of the keyway. The wide opening is on the side of the cylinder diametrically opposite the keyhole. The wide opening is sized to accept a plurality of lever tumblers so they engage the plug. The lever tumblers are mounted in a conventional manner on the lock case and lie outside above the plug and cylinder. The belly sections of the lever tumblers which serve as engaging means, pass through the wide opening in the cylinder and rest upon the body of the plug.

As the sides of the keyway at the front end of the plug are not opened, the shape and size of the keyway entrance remains the same as that for the keyhole. The width of the keyway, particularly of the circular shank accepting section closer to the axis, the extent of the keyway opening in its middle section and the wide opening in the cylinder wall, are interrelated. This relationship insures that as the plug is rotated from a position where the keyhole and keyway are aligned, the keyhole becomes totally sealed from inside by a front face of the rotating plug before the open middle section of the keyway approaches the wide opening in the cylinder wall. This insures that the lever tumblers are totally inaccessible from outside the lock through the keyhole at all times.

In the lock of the present invention, unlike conventional locks, the lever tumblers are not lifted by the key during locking and unlocking. Rather, the lever tumblers are allowed to slide down or frop to the required depths onto the edges of the lever steps on the key bit as the plug is rotated. Likewise, the lever tumblers are lifted off the lever steps by an edge of the open middle section of the plug upon further rotation of the plug. As the result of this arrangement, no selective lifting or lowering of the lever tumblers is possible as they can only be collectively lifted or lowered by rotation of the plug.

A dead bolt is mounted in a conventional manner on the lock case. A bolt stump projects through pockets cut in the lever tumblers. The bolt stump does not carry the weight of the lever tumblers as the tumblers normally rest on the plug. A thin talon of the bolt runs behind the cylinder and plug at the rear inside the lock. The bolt does not make any contact with the key bit during operation of the lock but is engaged by a bolt thrower which projects from the rear end of the rotating plug. The bolt and the bolt thrower serve as bolt movement means and are also totally inaccessible from outside the lock.

The key used in conjunction with the lock of the present invention has two (2) detachable parts. It consists of a flat key bit which is sized to be accepted in the keyway. The keybit carries the lever steps for engaging the tumblers. A detachable shank and bow section of the key is used for insertion and removal of the key bit from the keyway through the keyhole.

In operation of the lock, the plug is first rotated using the spindle handle to bring the keyway in alignment with the keyhole. The key bit is then inserted into the key way of the lock using the shank and bow section. The shank and bow section is then detached and withdrawn leaving the key bit inside the keyway. The plug is next rotated a full round in the required direction to effect locking or unlocking as the case may be. The key bit is removed after the locking or unlocking operation using the shank and bow section.

It may be seen from the above description that not only are the lever tumblers and dear bolt totally inaccessible from outside through the keyhole and keyway, but also the lever tumblers and the sliding bolt are not maneuverable. The movements of the lever tumblers and bolt are inter-dependent and directed automatically according to a preset pattern by the only movement performed from the outside; namely, rotation of the plug by the spindle handle. Further the lever pockets, bolt stump, bolt talon, bolt thrower and keyway are all so designed and positioned that upon rotation of the plug, the bolt thrower engages a square cut section of the talon which causes it to begin pushing the bolt. Thus, the bolt stump presses against the lever tumblers only at one given point; that is, when all lever tumberls have dropped onto the lever steps. This arrangement does not permit any contact between the bolt stump and the lever tumblers during the process of dropping or lifting the lever tumblers by rotation of the plug. Even an application of end thrust on the bolt head by gaining access through drilling or other means will not make any difference. These characteristics make the lock of the present invention theoretically unpickable.

Another special feature of the lock of the present invention is that by cutting the gatings in the lever tumblers in an appropriate manner, the lock can be made to lock automatically without using the key bit and by simply rotating the plug by its spindle handle one full round in a required locking direction. In addition to convenience, this keyless locking feature assumes greater importance and usefulness in emergency locking, particularly during holdups.

BRIEF DESCRIPTION OF DRAWINGS

A preferred embodiment of the invention, a single throw, keyless-locking lever lock left hand with a fixed cylinder and a rotatable plug is described hereunder in detail with reference to the accompanying drawings.

FIG. 1 is a front elevational view of the lever lock of the preferred embodiment with its cap plate removed showing the important elements of the lock in their general arrangement in assembled form. The keyway is shown with the key bit inside and in alignment with the keyhole. The position of the cap plate with its keyhole and spindle hole are shown in dotted lines. For convenience the lever tumbler is shown with the lock in the locked condition.

FIG. 2 is a side elevational view from the bolt head end of the lock.

FIG. 3 is a front elevational view similar to FIG. 1 with the plug assembly rotated to the unlocking condition.

FIG. 4 is a front elevational view of the plug assembly.

FIG. 12 is a front elevational view of the dead bolt.

FIG. 13 is a side elevational view of the dead bolt from the bolt head end.

FIG. 14 is an elevational view of the lever tumblers.

FIG. 15 is a cross-elevational view of the key bit.

FIG. 16 is a cross-sectional view of a key bit taken substantially on line 16—16 of FIG. 15.

FIG. 17 is a side elevational view of the shank and bow section of the key.

FIG. 18 is a fragmentary elevational view of the lower half of a cap plate showing the spindle hole and keyhole therein.

BEST MODES FOR CARRYING OUT INVENTION

Figure 5:
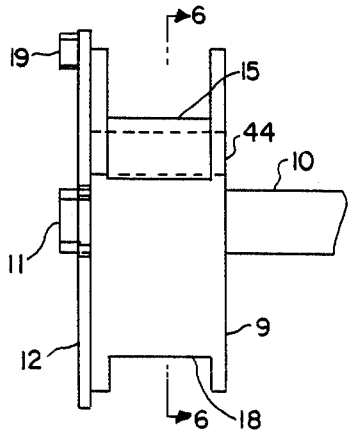
FIG. 5 is a side elevational view of the plug assembly.
Figure 6:
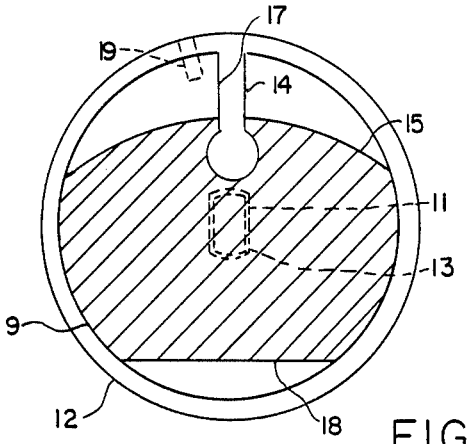
FIG. 6 is a cross-sectional view of the plug assembly taken substantially on line 6—6 of FIG. 5.
Figure 7:
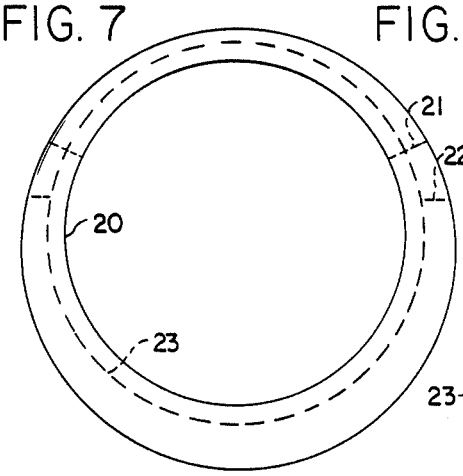
FIG. 7 is a front elevational view of the cylinder.

Referring now to the drawings and particularly to FIG. 1, the preferred embodiment of the lever lock of the present invention is shown having a lock case including a case plate 1 and a cap plate 2. Cap plate 2 contains a plug assembly 3, a cylinder 4, a dead bolt 5, and a plurality of lever tumblers 6. For convenience only, one lever tumbler is shown in the drawing. The lock is operated with a key consisting of two (2) detachable parts. The key bit 7 and the shank and bow section 8 make up the key as shown in FIGS. 15 and 17.

As shown in FIG. 4, the plug assembly 3 consists of a solid cylindrical plug 9 having a thin and long spindle 10 projecting longitudinally forward from its center. A short projection 11 projects from the rear end of the plug (see FIG. 5). This short projection 11 is similar in diameter to spindle 10 but with two (2) diametrically opposed flats. Plug assembly 3 also incorporates a disk 12 having a diameter slightly larger than that of the plug. Disk 12 incorporates a non-circular hole 13 at its center to accept projection 11. Disk 12 is fastened to the plug by fastening means (not shown) so as to move with it. The plug assembly also incorporates a front face disk 44. The length of spindle 10 will vary with the thickness of a door on which the lock is used. The spindle may be an integral part of the plug or a separate part fastened to the plug at a time of fixing the lock on the door. Other embodiments of the spindle may be detachable and used only during operation. In the preferred embodiment the plug is rotated by using a handle of conventional design (not shown) fitted at the end of the spindle outside the door.

The plug incorporates a full length keyway 14 for accepting and holding a key bit. At the front of the plug the keyway is in the form of an open slit extending through the front plate 44 of the plug assembly. A keyway opening 15 is cut traversely into the plug at the center of keyway 14, leaving the two (2) ends at plug front end 16 and plug rear end 17 in proper shape to accept and hold the key bit when it is inserted. The keyway 14 is sealed at the rear end of the plug by disk 12. On the side of plug 9 diametrically opposite to the keyway and over a length corresponding to keyway opening 15, the plug includes a flat 18 with a maximum depth of about half of the maximum depth of the key way opening. Disk 12 at the rear end carries a bolt thrower 19 in the form of a small rectangular projection extending from its rear side. Bolt thrower 19 is positioned near the periphery of the disk, close to the line of the keyway. Bolt thrower 19 projects backwards to about the same extent as the short projection 11. Plug assembly 3 instead of being assembled from parts as above described can alternatively be fabricated as a one-piece cast unit.

Figure 8:
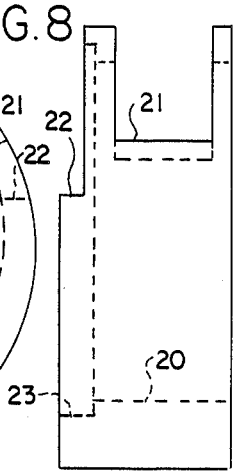
FIG. 8 is a side elevational view of the cylinder.

Cylinder 4 surrounds a large hole 20. Hole 20 runs the length of cylinder 4 and is slightly off center therein. The hole is suitable diameter to enable smooth rotation of plug assembly within it and is open at both ends. The length of cylinder 4 is slightly more than that of the combined length of plug assembly 3 and projection 11 at the rear so as to enable smooth rotation of the plug between the case and cap plates. At the thin walled side at the top of cylinder 4, a wide opening 21 is cut through the wall of the cylinder to provide access for the lever tumblers (see FIGS. 7–10). The width of wide opening 21 corresponds to keyway opening 15 of the plug. At the rear end of cylinder 4 a section of the cylinder wall is removed over a small length to create a passage 22 for accepting a bolt talon 29 (see FIG. 8). From the rear end of the cylinder up to a point just past bolt talon passage 22 the cylinder hole 20 is enlarged to provide a wider hole 23 sized for the acceptance and rotation of disk 12 on the rear of plug 9.

Figure 9:
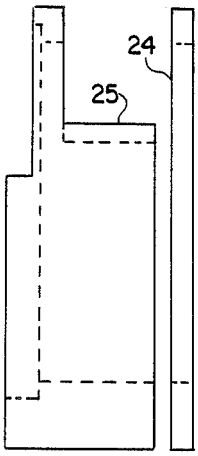
FIG. 9 is a side elevational view like FIG. 8 but showing the cylinder base and cylinder ring separately.
Figure 10:
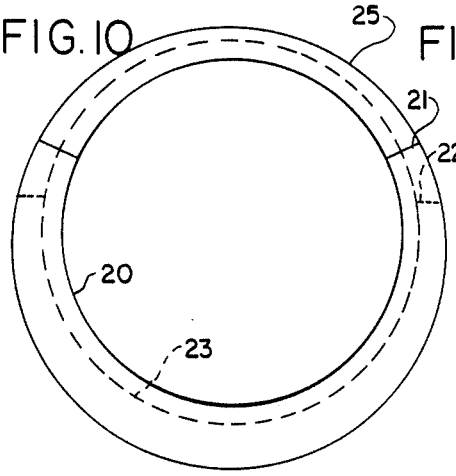
FIGS. 10 and 11 are front elevational views of the cylinder base and cylinder ring.
Figure 11:
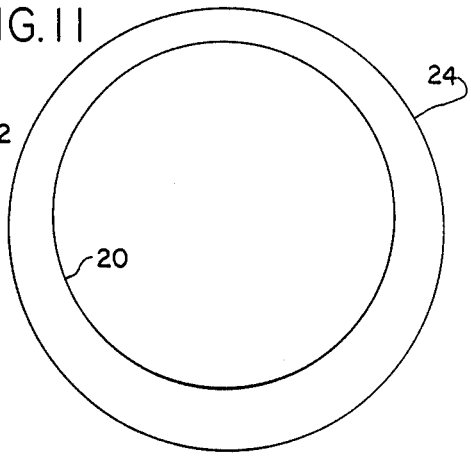

The cylinder 4 described above, may cause some inconvenience in mounting the lever tumblers during lock assembly. It is therefore preferred that the cylinder be made as two (2) separate parts as shown in FIG. 9. The front section is a cylinder ring 24 and the rest of the cylinder is a cylinder base 25.

As shown in FIGS. 12 and 13, and dead bolt 4 consists of a long, thick, and sturdy flat bar. One end of the bar forms a bolt head 26 and the other end includes a lanket hole 27. A bolt stump 28 projects from about the middle of the bar. Bolt talon 29 which is a thin rectangular strip with a notch therein, extends from the base of the bolt at its mid-section. The bolt stump 28 is preferably triangular in section as shown with its wide end facing the pivot end of the lever tumblers and its pointed end facing the opposite way.

The lever tumblers 6 as shown in FIG. 14 vary in number according to the requirements of the lock. In the preferred embodiment of the lock, the lever tumblers have flat bellies for engaging the plug and the lever steps on the key bit. Every lever tumbler incorporates two (2) pockets, an outer pocket 30 and an inner pocket 31. The bolt stump 28 is positioned in the outer pocket 30 when in the locked condition and the inner pocket 31 when in unlocked condition. The two (2) pockets are connected by a gaing 32. The gating at the point of entry from the outer pocket is of just the correct width for accepting the wide end of the triangular bolt stump 28. The inner pocket 31 is tapered toward the gating from its effective full width to gating 32. The taper serves as a funnel which directs stump 28 through gating 32 and into outer pocket 30 when dead bolt 5 is moved to the left in FIG. 3. This occurs regardless of whether stump 28 is initially aligned with gating 32 in inner pocket 31. This feature facilitates keyless locking as later discussed.

As shown in FIGS. 15 and 16, key bit 7 consists of a flat rectangular bit with a round pin or shank of the same length at one edge. The key bit is of just the correct size to slip in and occupy the keyway 14 in plug 9 without any play during operation. The key bit incorporates a plurality of lever steps 33 over a major portion of its length in its mid-section, leaving a front end 34 and a rear end 35 of the key bit with full metal. When inserted into keyway 14, the two (2) uncut front and rear ends 34 and 35 respectively of the key bit occupy the similarly shaped plug front and rear ends 16 and 17 of keyway 14. This fit eliminates any possibility of tilting or misalignment of the key bit during operation of the lock.

The shank and bow section 8 of the key (see FIG. 17) is not of significance to the security of the lock. It consists of a bow 37 and a shank 36. It is used only for inserting and withdrawing key bit 7 into and from keyway 14 through key hole 38 from the outside of the door to which the lock is attached. Shank and bow section 8 is of similar length to plug spindle 10 so as to permit it to extend through the door. Bow 37 can be of any shape and size desired. In the preferred embodiment the shank 36 and key bit 7 are attached and detached by threading means.

In the assembly of the preferred embodiment of the lock, the dead bolt 5 is first mounted on the case plate 1 in the upper half of the case in the position shown in FIG. 1. In this preferred embodiment as the lever tumblers 6 do not normally rest on bolt stump 28, the bolt 5 is totally free of any pressure and it may move. It is therefore preferred that a steadying means such as a small spring-loaded finger be provided along with corresponding detents in the bolt to keep the bolt steady.

Plug assembly 3 is then slipped into base 25 of the cylinder through the rear end of hole 20 till the outward disk 44 of the plug assembly 3 reaches opening 21 in the cylinder. The combined plug assembly 9 and cylinder base 25 are positioned on the case plate 1 in the lower half of the case plate. Cylinder base 25 is fixably mounted to the case with fastening means with its thick walled side down and opening 21 and passage 22 upwards towards the dead bolt. The plug assembly 3 is prevented from any axial sliding movement by the short projection 11 which is adjacent the cap plate and the disk 12 which is held in wider hole 23 of the cylinder base. The plug is able to rotate freely and to engage bolt talon 29. The lever tumblers 6 are now mounted on a pivot 40 above the bolt with their bellies extending through opening 21 in the cylinder wall so as to rest on the body of the plug 9. The tumblers are biased towards plug 9 by spring clips 42. The cylinder ring 24 is then slipped into position and fastened to the cylinder base 25 by fastening means. The cap plate 2 of the lock case is finally placed on top. The spindle 10 is journaled in a spindle hole 38 of the cap plate. The cap plate is fastened to the cylinder and the case plate by fastening means (not shown). In the assembled condition, keyhole 39 in the cap plate is directly below spindle hole 38.

Before the assembled lock is mounted on an associated door, holes providing access for the spindle 10 and to the keyhole 39 must be cut through the thickness of the door. A handle of conventional design (not shown) is fitted onto the end of the spindle 10 on the outside of the door to enable turning the spindle when the lock is in the unlocked condition.

The operation of the lock is new described. In the preferred embodiment, the key bit 7 must be used for unlocking but locking can be accomplished both with and without the key. During unlocking, the keyway/-keyhole alignment position must first be found before inserting the key. As the handle on the outside (and thereby the plug assembly inside the lock) is rotated, the plug assembly 3 comes to rest with a click when the flat bellied lever tumblers 6 pressed by their springs 42 drop into flat 18 on the plug on the side diametrically opposite keyway 14. This position will automatically indicate the only point at which keyway 14 is in alignment with the keyhole 39.

Having brought keyway 14 and keyhole 39 into alignment, the key bit 7 is inserted into the keyway 14 through the keyhole using the shank and how section 8. The shank and bow section is then detached from the key bit and withdrawn. The keyway may be provided with a small spring-loaded steadying device (not shown in the drawings) similar to that previously suggested for steadying the bolt, to temporarily retain the key bit inside the keyway. This prevents the key bit from slipping outwards in the case when the shank and bow section is detached or withdrawn carelessly.

With the key bit in position within the keyway, the handle is rotated in the clockwise direction for the left-hand lock shown. During this process plug assembly 3 first seals the keyhole from inside as front face disk 44 of the plug blocks the keyhole 39 as keyway 14 passes out of alignment. The plug assembly then carries key bit 7 around to the upper side of cylinder 4 adjacent opening 21.As the lever tumblers 6 engage the plug the surface of which serves as a cam, and as it is rotated to bring key bit 7 adjacent opening 21 in the cylinder, the tumblers engage opening 15 which causes them to drop onto the key bit when the keyway is at top center. Simultaneously, the bolt thrower 19 on the back of the plug assembly is also carried around to the upper side for engagement with the notch in the bolt talon 29. When the correct key bit 7 is used, the gatings 32 of the tumblers will be aligned and thereby plug assembly 3 can be rotated further to complete a full round, moving the bolt and thereby accomplishing the unlocking process. In the event a wrong key bit is used or in the absence of any key bit within the keyway, the handle and the plug assembly cannot be rotated in the unlocking direction beyond the half-round due to the stump 28 of the bolt being held in the outer pocket 30 of the tumblers due to non-alignment of the gatings. After unlocking, the key bit can be withdrawn immediately. At the completion of a full round, the key way and keyhole are again aligned. With or without the key bit inside, the handle can now be rotated a full round in the anti-clockwise direction to accomplish locking.

It is preferred that certain safeguards against the application of excessive torque on the handle and spindle be incorporated in the lock to prevent any damage to the bolt stump. Various methods can be used. Easily breakable pins or screws can be employed for fixing the handle to the spindle. This safeguards against accidental or unintentional application of excessive torque and allows the handle to be easily refitted. To guard against the intentional application of excessive torque, either the spindle can be made as thin as the system permits or a circular groove can be cut at a point near the plug end for the spindle to snap. As an alternate precaution, a breakable bolt thrower may also be provided. If the bolt thrower breaks, the plug will rotate freely in either direction.

In an alternative embodiment (not shown in the drawings), the lock can provide dual control facilities by a double throw system. In this alternative embodiment, two (2) separate key bits having different steps are used to accomplish the two (2) throws of the same bolt over two (2) separate but consecutive ranges. In this embodiment the first key bit locks and unlocks over the first range and the second key bit locks and unlocks over a second range. The only changes required to the lock shown in the drawing to provide this feature are in the bolt, which would incorporate two (2) talons adjoining each other, and in the lever tumblers, each of which would have three (3) pockets with two (2) gatings thereinbetween. The pockets closer to the pivoted end would have gatings that correspond with the steps in the first key bit to move the bolt by the talon on the side closest to the lanket hole over the first range. The gatings between the pockets farthest from the pivoted end of the tumber would be differently gated to correspond with the steps in the second key bit to operate the bolt by its second talon over the second range.

The keyless locking feature can be used with the double throw, dual control embodiment described above and still maintain the basic characteristic of unpickability. Thus, this alternative embodiment of the invention provides a dual control lock that is truly safe and secure, which is suitable for maximum security requirements.

In still another possible embodiment of the invention, a lock may be provided with a rotatable hollow cylinder and a fixed plug. The cylinder serves as an enclosure for the plug and has a cover at its front end, the axial part of which is extended in the form of a spindle. The spindle is projected through a cap plate of the lock at the front. The plug in this alternative embodiment is fastened to a back plate of the lock case. The plug incorporates a keyway in its body along the upper side. The keyhole in the cap plate of the lock is also positioned in line with the keyway directly above the spindle hole. The rotatable cylinder also has a similar sized keyhole in its front end cover plate at the appropriate distance from its axis to fall in line with the keyway and a main keyhole in the front cap plate. The cylinder, on the side diametrically opposite to that of its keyhole is provided with an opening in its wall for access by lever tumblers. The cylinder also carries a bolt thrower at its rear end. The lever tumblers normally rest on the body of the cylinder; however, when the cylinder is rotated by the spindle handle, the lever tumblers slide down from the rim of the opening in the cylinder to their required depths onto the steps of the key bit held in position in the keyway of the stable plug. Upon further rotation, after accomplishing locking or unlocking, the lever tumblers are lifted back by the rim of the opening and again ride on top of the cylinder body. In this form of the invention, the bellies of the lever tumblers must be suitably curved to move smoothly over the openings in the cylinder. The front cover of the cylinder should be of hard material resistant to drilling to insure adequate security. The features and operations of this alternative embodiment are generally similar to that of the embodiment shown in the drawings.

Thus, the invention achieves the above-stated objectives, eliminates difficulties encountered in the use of prior devices, solves problems and attains the desirable results described herein.

In the foregoing descriptions, certain terms have been used for brevity, clarity and understanding. However, no unnecessary limitations can be implied therefrom because such terms are used for descriptive purposes and are intended to be broadly construed. Moreover, the description and illustrations given are by way of examples and the invention is not limited to the exact details shown or described.

Having described the features, discoveries and principles of the invention, the manner in which it is utilized, and the advantages and useful results obtained, the new and useful structures, devices, elements, arrangements, parts, combinations, systems, equipment, operations, methods and relationships are set forth in the appended claims.

I claim:

1. A lock settable from a secured condition to an unsecured condition by insertion therein of a proper key bit, said key bit including lever steps, said lock having a case including a keyhole for accepting the key bit, a bolt mounted for movement on said case and movable between first and second positions corresponding to said secured and unsecured conditions respectively, and a plurality of tumblers mounted for movement on said case, said tumblers having an oriented condition when in engagement with said lever steps of said key bit, said lock comprising:

a plug mounted for movement on said case, said plug including a cam surface and a keyway for accepting and holding said key bit;

movement means for moving said plug assembly in a first direction from a first location in alignment with said keyhole to a second location away from said keyhole;

a plurality of tumblers mounted for movement on said case, said tumblers including engaging means for engaging said cam surface and said lever steps;

biasing means for biasing said engaging means fo said tumblers toward said plug; and bolt movement means for moving said bolt from said first position to said second position responsive to the oriented condition of said tumblers, whereby movement of said plug in the first direction from the first location engages said cam surface and said engaging means, maintaining said tumblers from said lever steps until said plug is in the second location wherein said engaging means disengages said cam surface and engages said lever steps.

2. The lock according to claim 1 wherein said plug is rotatable, said movement means is a spindle mounted on said plug and extending through said lock case, and said plug includes a front plate for blocking said keyhole when the keyway and keyhole are not in said first location.

3. The lock according to claim 2 wherein said tumblers are lever tumblers having a first pocket and a second pocket with a gating thereinbetween, said oriented condition of said tumblers is an aligned condition of said gatings, and said bolt includes a bolt stump, said bolt stump being accepted in said pockets and passing through said gatings in the aligned condition from said first pocket to said second pocket as the bolt moves between said first and second conditions.

4. The lock according to claim 3 wherein said second pockets are tapered from their full width to said gatings, and further comprising bolt extending means for moving said bolt from said second position to said first position responsive to a locking movement of said plug, whereby said bolt is enabled to move from said second position to said first position when said gatings are not in the aligned condition.

5. The lock according to claim 3 wherein said second location is diametrically opposite to said keyhole.

6. The lock according to claim 3 wherein said bolt is a sliding bolt and said bolt movement means includes a talon of said bolt engaging a bolt thrower on said plug, said talon disengaged from said bolt thrower during rotation of said plug from said first location to said second location, said bolt thrower engaging said talon at the second location to move said bolt from said first position to said second position in responsive to further rotation of the plug in the first direction.

7. The lock according to claim 6 wherein said second pockets are tapered from their full width to said gatings, and said bolt thrower engages said talon in response to rotation of said spindle in a direction opposed to said first direction, whereby said bolt is moved from said second position to said first position in response to rotation of the spindle in the opposed direction when said gatings are not in the aligned condition.

8. A lock settable from a secured condition to an unsecured condition in response to insertion therein of a proper key bit, said key bit including lever steps, said lock having a case including a keyhole for accepting the key bit, a bolt mounted for movement on said case and movable between first and second positions corresponds to said secured and unsecured conditions respectively, and a plurality of tumblers mounted for movement on said case, said tumblers having an oriented condition when in engagement with said lever steps of said key bit, said lock comprising:

a keyway on said case for accepting and holding said key bit;

an enclosure for said keyway mounted for movement on said case and movable between a first and a second location, including first access means for access through said enclosure from said keyhole to said keyway in the first location, a cam surface and second access means through said enclosure for access to said lever steps in said second location;

movement means for moving said enclosure in a first direction from said first location to said second location;

a plurality of tumblers mounted for movement on said case, said tumblers including engaging means for engaging said cam surface and said lever steps through said second access means;

biasing means for biasing said engaging means of said tumblers toward said lever steps; and bolt movement means.for moving said bolt from said first position to said second position responsive to the oriented condition of said tumblers, wherein movement of said enclosure in the first direction from said first location engages said cam surface and said engaging means, disposing said tumblers from said lever steps until said plug is in the second location wherein said engaging means disengages said cam surface and engages said lever steps.

9. The lock according to claim 8 wherien said enclosure is a rotatable cylinder and includes a front plate for blocking access from said keyhole to said keyway when said enclosure is not in said first location.

10. The lock according to claim 9 wherein said movement means is a spindle mounted on said enclosure and extending through said lock case.

11. The lock according to claim 9 wherein said second access means is an opening in a circumferential portion of said cylinder diametrically opposed of said first access means.

12. The lock according to claim 11 wherein said tumblers are lever tumblers having a first pocket and a second pocket with a gating thereinbetween, said oriented condition of said tumblers is an aligned condition of said gatings, and said bolt includes a bolt stump, said bolt stump being accepted in said pockets and passing through said gatings in the aligned condition from the first pocket to the second pocket as the bolt moves from the first to the second position.

13. the lock according to claim 12 wherein said second pockets are tapered from their full width to said gatings and further comprising bolt extending means for moving said bolt from said second position to said first position responsive to a locking movement of said cylinder, whereby said bolt is enabled to move from said second position to said first position when said gatings are not in the aligned condition.

14. The lock according to claim 12 wherein said bolt is a sliding bolt and said bolt movement means includes a talon of said bolt engaging a bolt thrower on said cylinder to move said bolt from said first position to said second position in response to rotation of the spindle in the first direction.

15. The lock according to claim 14 wherein said second pockets are tapered from their full width to said gating and said bolt thrower engages said talon in response to rotation of said spindle in a direction opposed to said first direction, whereby said bolt is moved from said second position to said first position in response to rotation of the spindle in the opposed direction when said gatings are not in the aligned condition.

16. A lock settable from a secured condition to an unsecured condition by insertion therein of a proper key bit, said key bit including lever steps, said lock having a case including a keyhole for accepting the key bit, a bolt mounted for movement on said case and movable between first and second positions corresponding to said secured and unsecured conditions respectively, and a plurality of tumblers mounted for movement on said case, said tumblers having an oriented condition when in engagement with said lever steps of said key bit, said lock comprising:

a plug mounted for movement on said case, said plug including a keyway for accepting and holding said key bit, a cam surface and an opening providing access to the lever steps of said bit;

movement means for moving said plug assembly in a first direction from a first location in alignment with said keyhole to a second location away from said keyhole;

a plurality of tumblers mounted for movement on said case, said tumblers including engaging means for engaging aid cam surface of said plug and said lever steps, said engaging means extending through said opening to engage the lever steps of the key bit int he second location;

biasing means for biasing said engaging means of said tumblers toward said plug; and bolt movement means for moving said bolt from said first position to said second position responsive to the oriented condition of said tumblers, whereby movement of said plug in the first direction from said first location engages said cam surface and said engaging means, maintaining said tumblers from said lever steps until said plug is in the second location wherein said engaging means disengages said cam surface and engages said lever steps.

17. The lock according to claim 16 and further comprising a bow and shank section and means for selectively attaching said bow and shank section and said key bit.

* * * * *